US011365547B2

(12) United States Patent
Randjelovic

(10) Patent No.: US 11,365,547 B2
(45) Date of Patent: Jun. 21, 2022

(54) ATHLETIC FLOOR AND METHOD THEREFOR

(71) Applicant: Erlin A. Randjelovic, Crystal Falls, MI (US)

(72) Inventor: Erlin A. Randjelovic, Crystal Falls, MI (US)

( * ) Notice: Subject to any disclaimer, the term of this patent is extended or adjusted under 35 U.S.C. 154(b) by 92 days.

(21) Appl. No.: 16/886,729

(22) Filed: May 28, 2020

(65) Prior Publication Data

US 2020/0386000 A1 Dec. 10, 2020

Related U.S. Application Data

(60) Provisional application No. 62/857,792, filed on Jun. 5, 2019.

(51) Int. Cl.

| | |
|---|---|
| ***E04F 15/22*** | (2006.01) |
| ***E04F 15/04*** | (2006.01) |
| ***E04F 15/02*** | (2006.01) |

(52) U.S. Cl.

CPC ..... *E04F 15/225* (2013.01); *E04F 15/02194* (2013.01); *E04F 15/043* (2013.01); *E04F 2015/02055* (2013.01); *E04F 2290/044* (2013.01)

(58) Field of Classification Search

CPC ... E04F 15/22; E04F 15/225; E04F 15/02194; E04F 15/18; E04F 15/188; E04F 2015/02055; E04F 2290/044; E04F 15/043

See application file for complete search history.

(56) References Cited

U.S. PATENT DOCUMENTS 498,344 A 5/1893 Wiliams
1,302,578 A * 5/1919 Murphy ..... E04F 15/20 52/402

(Continued)

FOREIGN PATENT DOCUMENTS

DE 19940837 A1 11/2000

OTHER PUBLICATIONS

Aset Services; "ASTM Introduces New Indoor Court Standard: F2772 Athletic Performance of Indoor Sport Systems"; article; published in the United States at least as early as Jun. 2, 2019; 3 pages; United States.

(Continued)

*Primary Examiner* — Kyle J. Walraed-Sullivan
(74) *Attorney, Agent, or Firm* — Davis & Kuelthau, s.c.

(57) ABSTRACT

A new athletic floor resiliently retrofit to a worn athletic floor having a supporting sleeper connected to a ground substrate. The new athletic floor incudes a channel section connected to the supporting sleeper, the channel section having a top plate located between and connected to each of a left vertical side wall spaced apart from a right vertical side wall. The left vertical side wall includes a left horizontal flange extending outward from the top plate and the right vertical side wall includes a right horizontal flange extending outward from the top plate. A left resilient pad rests on the left horizontal flange and a right resilient pad rests on the right horizontal flange. A new floor rests on the left resilient pad and the right resilient pad and is spaced from the top plate a first distance in a first resilient compression condition.

27 Claims, 5 Drawing Sheets

(56) References Cited

U.S. PATENT DOCUMENTS 1,587,355 A * 6/1926 Holger ..... E04B 5/12 52/370
2,046,593 A * 7/1936 Urbain ..... E04F 15/04 52/506.1
2,862,255 A * 12/1958 Nelson ..... E04F 15/225 52/403.1
4,110,948 A * 9/1978 Maier, Jr. ..... E04D 3/3608 52/489.1
4,170,859 A * 10/1979 Counihan ..... E04F 15/02 52/391
4,221,620 A * 9/1980 Milne ..... C09J 5/06 156/152
4,538,392 A * 9/1985 Hamar ..... E01C 13/04 52/584.1
4,879,857 A * 11/1989 Peterson ..... E01C 13/02 52/403.1
4,890,434 A * 1/1990 Niese ..... E04F 15/04 52/393
5,016,413 A * 5/1991 Counihan ..... E04F 15/18 52/385
5,253,464 A * 10/1993 Nilsen ..... E04F 15/22 52/508
5,277,010 A * 1/1994 Stephenson ..... E04F 15/225 52/403.1
5,299,401 A 4/1994 Shelton
5,365,710 A * 11/1994 Randjelovic ..... E04F 15/225 52/403.1
5,369,927 A * 12/1994 Counihan ..... E04F 15/22 52/403.1
5,412,917 A * 5/1995 Shelton ..... E04F 15/22 52/393
5,465,548 A * 11/1995 Niese ..... E04F 15/22 29/897.3
5,497,590 A * 3/1996 Counihan ..... E04F 15/22 52/480
5,647,183 A * 7/1997 Counihan ..... E04F 15/22 52/480
5,682,724 A * 11/1997 Randjelovic ..... E04D 11/005 52/403.1
5,761,867 A 6/1998 Carling
5,778,621 A * 7/1998 Randjelovic ..... E04F 15/22 52/376
6,032,427 A * 3/2000 Randjelovic ..... E04F 15/04 52/403.1
6,055,785 A * 5/2000 Counihan ..... E04F 15/22 52/403.1
6,122,873 A * 9/2000 Randjelovic ..... E04F 15/22 52/403.1
6,164,031 A * 12/2000 Counihan ..... E04F 15/02 52/480
6,363,675 B1 * 4/2002 Shelton ..... E04F 15/225 52/302.1
7,127,857 B2 10/2006 Randjelovic
7,694,480 B2 * 4/2010 Niese ..... E04F 15/22 52/403.1
7,703,252 B2 4/2010 Randjelovic
7,735,281 B2 6/2010 Randjelovic et al.
7,832,165 B2 11/2010 Randjelovic
8,307,597 B2 * 11/2012 Tucker, Jr. ..... E04F 15/046 52/480
8,464,486 B1 * 6/2013 Elliott ..... E04F 15/225 52/403.1
8,479,468 B1 7/2013 Abbasi
8,650,824 B2 2/2014 DeLong et al.
8,955,278 B1 2/2015 Mills
8,955,279 B1 * 2/2015 Clairmont ..... E04F 15/22 52/403.1
9,914,011 B2 3/2018 Downey et al.
10,174,509 B2 1/2019 Hayes et al.
10,676,920 B2 6/2020 Downey et al.
2002/0092255 A1 * 7/2002 Niese ..... E04F 15/225 52/480
2002/0108341 A1 * 8/2002 Hamar ..... E04F 15/225 52/403.1
2002/0178675 A1 * 12/2002 Valentine ..... E04F 15/225 52/403.1
2002/0189184 A1 * 12/2002 Shelton ..... E04F 15/225 52/403.1
2004/0040242 A1 * 3/2004 Randjelovic ..... E04F 15/225 52/403.1
2004/0098926 A1 * 5/2004 Haytayan ..... F16B 15/00 52/40
2004/0098927 A1 * 5/2004 Haytayan ..... B25C 1/188 52/40
2005/0257474 A1 * 11/2005 Randjelovic ..... E04F 15/22 52/480
2009/0139172 A1 * 6/2009 Harinishi ..... E04F 15/225 52/403.1
2009/0145057 A1 * 6/2009 Tsukada ..... E04F 15/0247 52/126.6
2010/0205885 A1 * 8/2010 Randjelovic ..... E04F 15/22 52/403.1
2010/0319286 A1 * 12/2010 Becker ..... E04F 15/182 52/390
2011/0232217 A1 * 9/2011 Hartl ..... E04F 15/18 52/309.1
2012/0017528 A1 * 1/2012 Liu ..... E04F 13/142 52/309.1
2012/0297713 A1 * 11/2012 Geith ..... E04B 5/46 52/306
2013/0008741 A1 * 1/2013 Kim ..... E04F 15/20 181/290
2013/0047537 A1 * 2/2013 Dao ..... E04F 15/18 52/309.3
2013/0104479 A1 * 5/2013 Thornton ..... E04F 15/225 52/309.4
2014/0311074 A1 10/2014 Cormier et al.
2014/0311075 A1 * 10/2014 Cormier ..... E01C 13/02 52/403.1
2015/0059276 A1 * 3/2015 Valentine ..... E04F 15/225 52/403.1
2016/0375296 A1 12/2016 Downey et al.
2017/0002572 A1 * 1/2017 Wagner ..... E04F 13/0821
2017/0051506 A1 * 2/2017 An ..... E04C 5/0631
2017/0114551 A1 * 4/2017 Sennik ..... E04F 15/186
2017/0114552 A1 * 4/2017 Randjelovic ..... E04F 15/22
2018/0155935 A1 * 6/2018 Gosling ..... E04F 15/02458
2018/0202150 A1 7/2018 Downey et al.
2020/0141131 A1 5/2020 Cormier et al.
2020/0340257 A1 * 10/2020 Valentine ..... E04F 19/0477
2021/0115682 A1 * 4/2021 Randjelovic ..... E04F 15/225
2021/0277669 A1 * 9/2021 Gasperich ..... E04F 15/22

OTHER PUBLICATIONS

Aset Services; "EN 14904: Introduction to Performance Types"; educational document; Copyright 2004; 4 pages; United States.
International Basketball Federation Association; "FIBA Equipment Rules 2020"; article; published in the United States at least as early as Jun. 2, 2019; pp. 17 and 18 (2 pages total); United States.
Maple Flooring Manufacturers Association; "MFMA PUR Standards: Performance & Uniformity Rating Sport Specific Standards"; educational document; published in the United States at least as early as Jun. 2, 2019; 4 pages; United States.

* cited by examiner

ATHLETIC FLOOR AND METHOD THEREFOR

CROSS-REFERENCE TO RELATED APPLICATION

This application claims the benefit of U.S. Provisional Application No. 62/857,792, filed Jun. 5, 2019, and titled: MANOR OF REPLACING WORN ATHLETIC FLOORS.

TECHNICAL FIELD

This invention relates to an economical and efficient manner for replacement of existing athletic floors that have exhausted wear life or experienced issues requiring replacement. More particularly, the invention relates to a worn athletic floor having supporting sleepers connected to a ground substrate and the sleepers being resiliently retrofit with a new athletic floor, and preferably using a new method, to have new wear life as taught herein.

BACKGROUND

Hardwood athletic floor systems typically provide a wear life of 50 years and longer depending on original flooring board thickness. Floors that are now frequently being replaced include wood sections referred to as sleepers, which were leveled over undulating concrete surfaces with assorted shims in various thicknesses. Sleepers were then secured to the substrate with anchoring fasteners penetrating the concrete. Such a method is illustrated in U.S. Pat. No. 1,587,355 by H. W. Raun introduced in 1926 and frequently installed into the 1970's.

In the most customary application, poured grout was included to fill cavities between the underside of sleepers and concrete surfaces with the finished pour reaching upward slightly higher than the underside of the sleepers. Poured hot tar was also used as a method of filling cavities below sleepers and normally also settled slightly above the underside of the sleepers. An added layer of subfloor material, commonly ¾ inch by 5 and ½ inch random length softwood boards were normally installed diagonally to the sleeper direction before attachment of tongue and groove type random length flooring.

Replacement of such floor systems creates numerous challenges, especially with the added preference to introduce resilience as is normally included in today's hardwood athletic floor systems. Removal of existing floor systems as described above commonly requires excessive labor and demolition especially when removing sleepers that are soundly secured to concrete. Preparation for installation of a new resilient hardwood athletic floor includes removal of poured grout, or tar filler that frequently includes hazardous materials requiring special abatement which creates health concerns and significant added disposal cost.

Beyond the cost and health concerns of full floor system removal, added material and labor cost become necessary after total demolition of the previous floor. Cavities commonly remain in the concrete surface after sleeper anchors must be forcefully removed which requires extensive patching. Such sleeper type systems that where acceptably shimmed over undulated concrete surfaces result in very uneven substrates after removal thus requiring expensive and time-consuming project delays to bring the substrate into acceptable tolerance.

In addition to challenges associated with removal and preparation work for installation of a new athletic floor system, resilient floors which are now desired frequently have profile heights differing from the original floor height. Solutions commonly require additional components to elevate floor system options or undesired ramps at doorways and/or adjacent surfaces to address uneven transitions.

SUMMARY

To address one or more of the deficiency discussed above, there is a need for a new athletic floor and method that improves current technology or techniques for replacing worn athletic floors.

As demonstrated in the following descriptions, my new athletic floor provides a manner to economically and efficiently replace common athletic floor systems that have exhausted wear life or are desired to be replaced by present-day resilient athletic floors as much as possible without completely having to remove the entire existing worn athletic floor. The invention takes advantage of allowing existing sleepers to remain in place rather than typical complete disposal of all components of the existing floor assembly. Thereby eliminating associated labor costs required for removal of sleepers and grout or asphalt filler, as well as fastening components embedded into the concrete substrate. Furthermore, the invention can eliminate the necessity of addressing hazardous materials such as asbestos included in hot poured asphalt commonly used in construction prior to understanding associated health risks. This can also help in eliminating significant labor costs, as well as added delays in construction schedules and disposal of hazardous material. For example, eliminating labor and patching material required to address fractures following removal of embedded concrete anchors, and/or leveling the original concrete base that is commonly found to be especially uneven and undulated.

Further, my new athletic floor can take advantage of existing sleepers remaining from the original floor system installation which are typically level and, in most instances, have sound integrity or require a modest number of replacement sections. I also provide a new athletic floor method to introduce resiliency and provide a newly completed floor which is equal or within an acceptable profile height tolerance equivalent to the original floor or new floor standards. That is, providing an equivalent profile height can also maintain desired flush transition to bordering surfaces without requiring special ramping at doorways or other adjacent floor surfaces. Still further, this can also help to protect resilient components and related assemblies from excessive compression when the floor surface is pressured under non-athletic loads.

In view of the foregoing, described herein in one embodiment is a new athletic floor resiliently retrofit to a worn athletic floor comprising a supporting sleeper connected to a ground substrate. The worn athletic floor includes a channel section connected to the supporting sleeper. The channel section includes a top plate located between and connected to each of a left vertical side wall spaced apart from a right vertical side wall. The left vertical side wall is including a left horizontal flange extending outward from the top plate and the right vertical side wall is including a right horizontal flange extending outward from the top plate. A left resilient pad is resting on the left horizontal flange and a right resilient pad is resting on the right horizontal flange. A new floor is resting on the left resilient pad and the right resilient pad and is spaced from the top plate a first distance in a first resilient compression condition.

In another embodiment there is a method to resiliently retrofit a worn athletic floor to have new wear life. The worn athletic floor includes a supporting sleeper connected to a ground substrate. The method includes the following steps, generally in this order but not required to be so as long as the desired retrofit floor is achieved. One step is connecting a channel section to the supporting sleeper. The channel section has a top plate including a left horizontal flange extending outward from the top plate and a right horizontal flange extending outward from the top plate. Another step is resting a left resilient pad on the left horizontal flange and a right resilient pad on the right horizontal flange. A next step is locating a new floor on the left resilient pad and the right resilient pad. And then, a step is compressing the resilient pads a first distance in response to a first resilient compression condition.

Other embodiments are direct to the vertical side walls and their configurations, the horizontal flanges and their configurations, the new floor and its components as well as its connected configuration with the supporting sleeper, and the resiliently retrofit functionality of the worn athletic floor in response to compressive forces applied to the new floor during use.

As used herein, "connect" (and formatives thereof, including connected and connecting) means the components or parts are attached to each other and would require a force to separate them.

As used herein, "directly" means there is substantially no intervening components or function that adversely impacts the relatedness of the two components or their functions.

As used herein, "indirectly" means there is some intervening components or function that separates the relatedness of the two components or their functions but still allows enough of the relatedness of the two components to exist to accomplish the stated purpose, e.g., being connected, being adjacent, and/or in combination with another function like movable.

As used herein, "horizontal" (and formatives thereof) means a plane parallel to the ground substrate including being within plus or minus about 30 degrees of parallel to the ground substrate.

As used herein, "vertical" (and formatives thereof) means a plane perpendicular to the ground substrate including being within plus or minus about 30 degrees of perpendicular to the ground substrate.

BRIEF DESCRIPTION OF THE DRAWINGS

The invention may be more completely understood in consideration of the following detailed description of various embodiments of the invention in connection with the accompanying drawings, in which.

Figure 1:
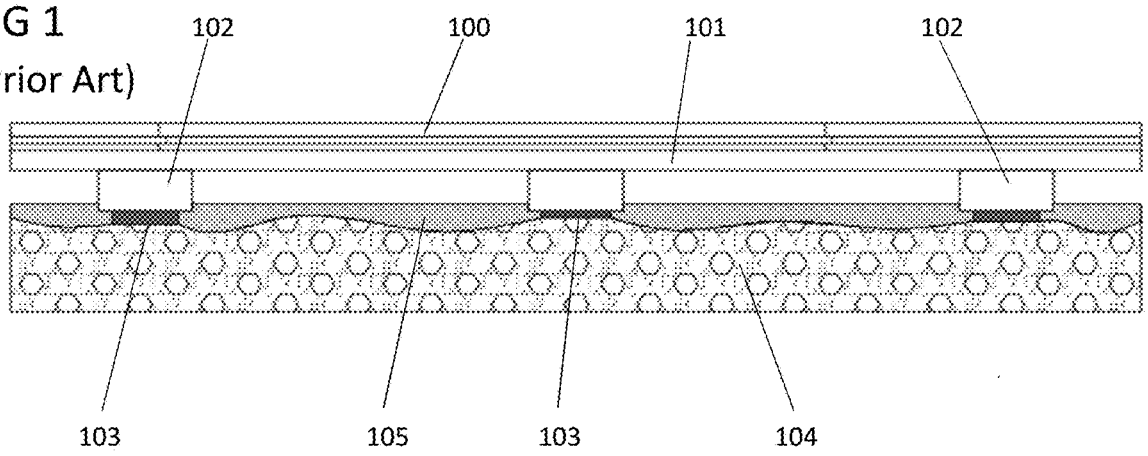
FIG 1 (Prior Art)
FIG. 1 is an end cut away view of a prior art worn athletic floor section.

The drawings show some but not all embodiments. The elements depicted in the drawings are illustrative and not necessarily to scale, and the same (or similar) reference numbers denote the same (or similar) features throughout the drawings.

DETAILED DESCRIPTION

In reference to FIG. 1, there is a prior art worn athletic floor frequently determined for replacement include a floor surface 100, typically common tongue and groove random length maple flooring with a thickness of 33/32 inch or 25/32 inch when initially installed. The flooring surface 100 rests on a subfloor 101 typically provided as a layer of ¾ inch by 5 and ½ inch softwood planks aligned diagonally and resting on supporting sleepers 102 that are commonly aligned 16 inches on center in adjacent rows. Sleepers 102 normally rest on shim material 103 provided in various thicknesses as related to undulated elevation of the concrete substrate 104 for the purpose of matching the profile height of sleeper surfaces prior to attachment of the subfloor 101. Sleepers 102 are attached to the concrete substrate 104 by hammer driven steel anchors (not shown) or embedded steel clips (not shown) which require especially aggressive means to remove, resulting in considerable gouges in the concrete substrate surface. Filler material 105 such as grout or poured asphalt normally extends slightly upward, ⅛ inch to ¼ inch, against the side edges of the sleepers 102 to fill voids between the underside of the sleepers and the surface of the concrete substrate 104. To prepare the worn athletic floor to be retrofit with the invention disclosed here, a worn athletic floor portion including the worn surface 100 and subfloor 101 are removed, exposing supporting sleepers 102.

Figure 7:
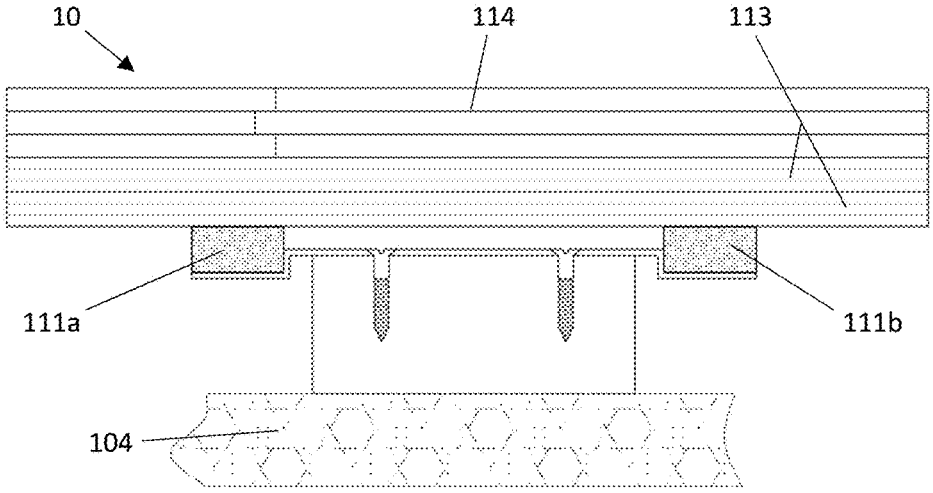
FIG. 7 is an end view of that seen in FIG. 4, now with a new floor resting on the resilient pads and spaced from the top plate a first distance in a first resilient compression condition.

In accordance with the practice of at least one embodiment of the invention, as seen in FIGS. 3-4 and 7-11 for example, there is the worn athletic floor including supporting sleeper 102 connected to ground substrate 104, and ready to be resiliently retrofit to have new wear life. The new athletic floor 10 includes a channel section 106 connected to the supporting sleeper 102. The channel section includes a top plate 107 located between and connected to each of a left vertical side wall 108*a* spaced apart from a right vertical side wall 108*b*. The left vertical side wall 108*a* is including a left horizontal flange 109*a* extending outward from the top plate 107. The right vertical side wall 108*b* is including a right horizontal flange 109*b* extending outward from the top plate. A left resilient pad 111*a* is resting on the left horizontal flange 109*a*. A right resilient pad 111*b* is resting on the right horizontal flange 109*b*. A new floor is resting on the left resilient pad 111*a* and the right resilient pad 111*b* and is spaced from the top plate 107 a first distance in a first resilient compression condition (as seen in FIG. 7).

Figure 2:
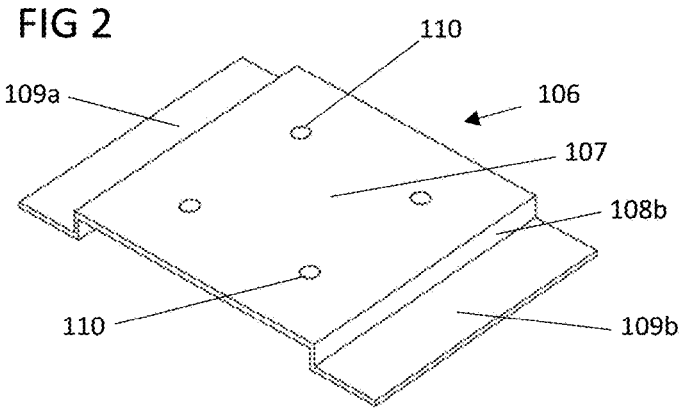
FIG. 2 is a perspective view of a channel section for attachment to existing supporting sleepers of the worn athletic floor.
Figure 3:
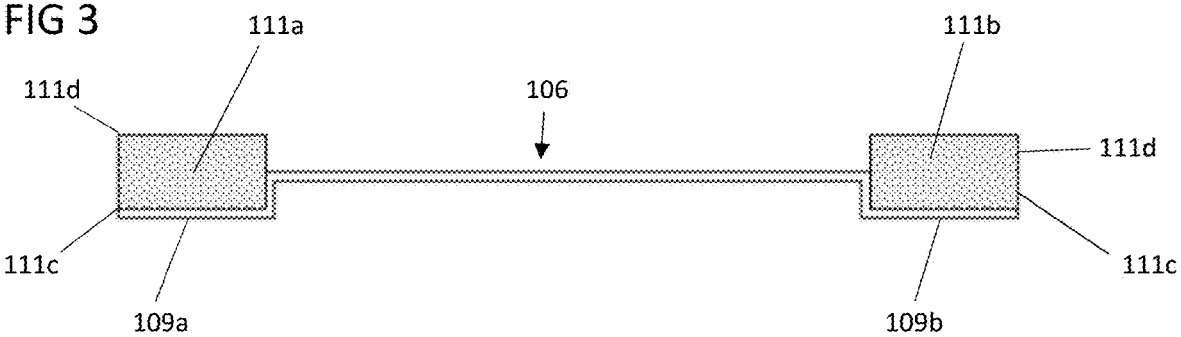
FIG. 3 is an end view of the channel section seen in FIG. 2, now including resilient pads.
Figure 4:
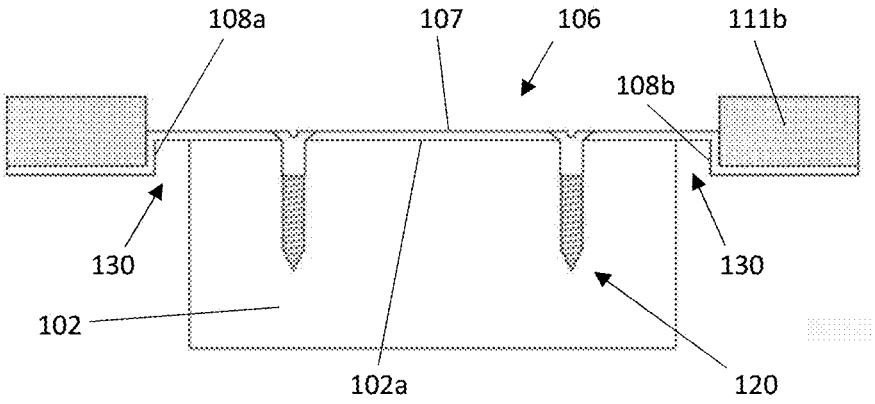
FIG. 4 is an end view of the channel section seen in FIG. 3, now connected to the existing supporting sleeper.
Figure 5:
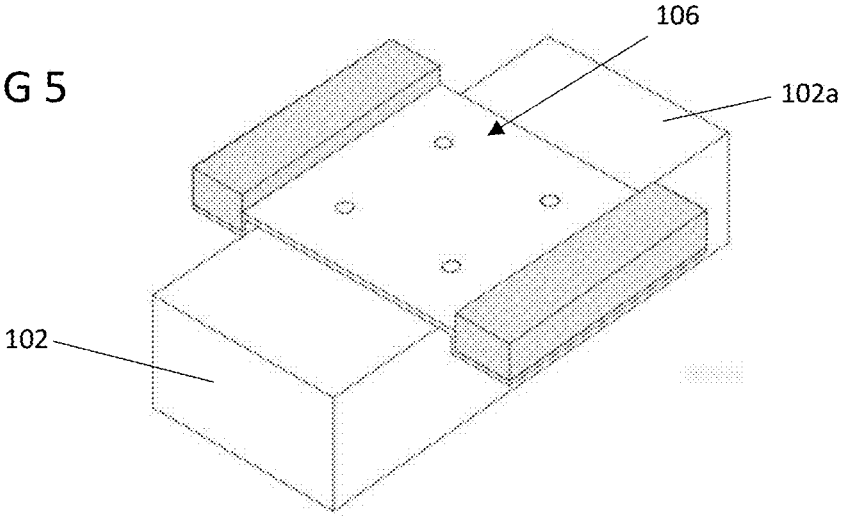
FIG. 5 is a perspective view of a channel section with and resilient pads resting on a portion of the existing sleeper.
Figure 6:
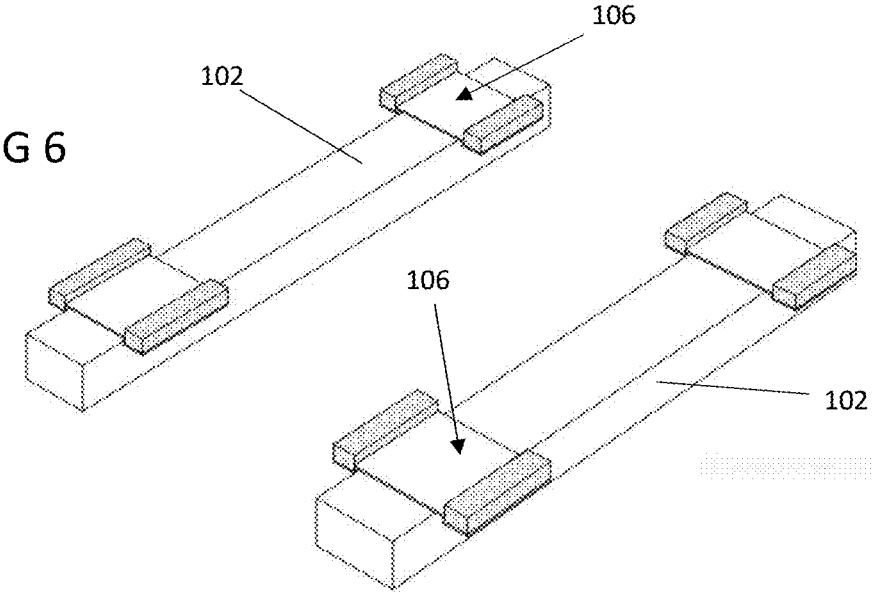
FIG. 6 is a perspective view of a plurality of the components seen in FIG. 5 as they may be retrofit to existing supporting sleepers.

In reference to FIGS. 2-4, inclusive, additional features of the channel section 106 can be understood. For example, and specifically in reference to FIGS. 4-7, at least one and preferably each, vertical side wall 108*a*, 108*b*, can be located outward from the supporting sleeper 102. More preferably in this regard, there is a gap 130 formed that separates each such vertical side wall 108*a*, 108*b* from the supporting sleeper at respective outer side edges of sleeper 102. In another aspect, at least one and preferably each, vertical side wall 108*a*, 108*b* extends toward the ground substrate 104 (to which each sleeper 102 is attached) at least in part and preferably in total.

In terms of its material make up or manufacture, channel section 106 can be steel or other rigid material, and is a preferably made of 14-gauge to 18-gauge steel and more preferably 16-gauge steel but can be other than steel and metal such as hard plastics or composites of metal, plastic and other material in a solid state at room temperature that has the desired strength and rigidity as taught herein. Horizontal flanges 109*a*, 109*b* preferably extend outward about one inch from the vertical side walls 108*a*, 108*b* and range from about ¾ inch to 2 inches. Horizontal flanges 109 are preferably about 4 inches long and preferably no less than about 2 inches in length with length reaching as long as about 8 feet. Outer vertical side walls 108*a*, 108*b* preferably measure about ¼ inch in height and can range in height from about ⅛ inch to 1 inch, with length dimension as described above for horizontal flanges 109*a*, 109*b*. The top plate 107 preferably measures about 4 inches wide and 4 inches in length (e.g., FIG. 8-9), with the length range correlated to that as described for the horizontal flanges 109*a*, 109*b* and vertical side walls 108*a*, 108*b*, so length could be about 2 inches to 8 feet if desired. When made with preferred 16-gauge steel, the width of the underside of the top plate measures about 3 and ⅞ inches between the inside dimension of vertical side walls 108*a*, 108*b* and is preferred to be a range of about 3 and ¾ inches to 4 and ¼ inch wide. Anchorage hole(s) 110 can be included in the top plate 107 as one way of attachment to sleepers, when desired. For example, as in FIG. 4, a mechanical fastener can be used to pass through hole(s) 110 and connect to the sleeper underneath, including screws, nails, bolts, spikes, and even (not specifically shown) adhesives like glue, caulk or double sided tape located between plate 107 and sleeper 102, and similar materials or structures as would be known to one or ordinary skill in the art in combination with the teachings herein.

Figure 2A:
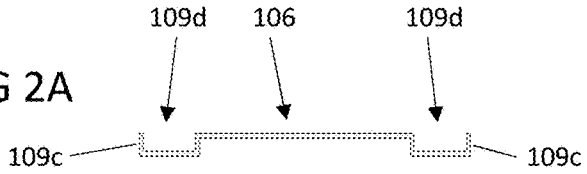
FIGS. 2A & 2B are end views of alternate embodiments of the channel section seen in FIG. 2.
Figure 2B:
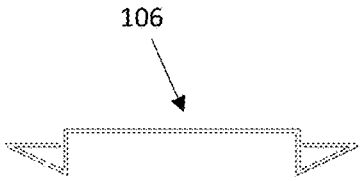

In reference to FIG. 2A and FIG. 2B, there are examples of alternate embodiments of the channel section 106 of the new athletic floor. For example, at least one of the left horizontal flange 109*a* and the right horizontal flange 109*b* can include a flange end stop 109*c* to define a horizontal flange channel 109*d*. Channel 109*d* can aid in locating and/or connecting the resilient pads in place relative to the flanges 109*a*, 109*b*. In another embodiment, at least one of the left horizontal flange 109*a* and the right horizontal flange 109*b*, and when this is so preferably both, is indirectly connected to its vertical side wall, as seen in FIG. 2B. In this way, while still a substantially rigid horizontal flange, some additional resiliency and/or flexibility can be provided to the horizontal flanges when desired.

As seen throughout, resilient pads 111*a*, 111*b* can measure about 1 inch wide by 4 inches long by ½ inch thick, in a preferred embodiment. When desired to be connected to the horizontal flanges and not just resting there, hot melt adhesive or another suitable adhesive or adhesive-like material can be used. Suitable pad dimensions can range from about ¾ inch to 2 inches in width, about 2 inches to 8 feet in length, and about ⅜ inch to 1 and ¼ inches in thickness. Resilient pads 106 can be manufactured from recycled rubber/foam having a density value of about 18-28 PCF (pounds per cubic foot, as determined by one of ordinary skill in the art using the athletic floor industry standard for measuring this parameter) and measure about 22-24 PCF for preferred applications. Pad material is not limited to recycled rubber/foam and can be provided by other resilient material (e.g., polyurethane open cell foam, polyethylene closed cell foam, natural rubber, synthetic rubber), as long as the desired PCF is attained. In this regard, the desired PCF is dependent upon the retrofit floor's desired resiliency characteristics for its useful life including loaded and loaded conditions and during athletic play as well as moving loads over the new floor in between athletic play, and can be determined by one or ordinary skill in the art in combination with the teachings herein.

In reference to FIG. 7, in a preferred embodiment the new floor can be a subfloor 113 sitting underneath and connected to a floor surface 114. For example, resilient pads 111*a*, 111*b* can support two layers of plywood forming subfloor 113 for support and attachment with floor surface 114, typically tongue and groove random length hard maple flooring having thickness of about 25/32 inch and 2 and ¼ inch face width. The two plywood layers may further each be about ⅜ inch thick to form an about ¾ inch overall subfloor 113 thickness. Other sheathing material aside from plywood, such as oriented strand board, can be used and sheathing layer thickness can range from about ¼ inch to 1 inch thickness. Upper and lower layers can be of different thicknesses when combined together and can range from a single layer to multiple layers. The subfloor layers can be attached together with ¾ inch fasteners (typically coated staples) and preferably rests freely as supported by resilient pads 111*a*, 111*b*.

Figure 8:
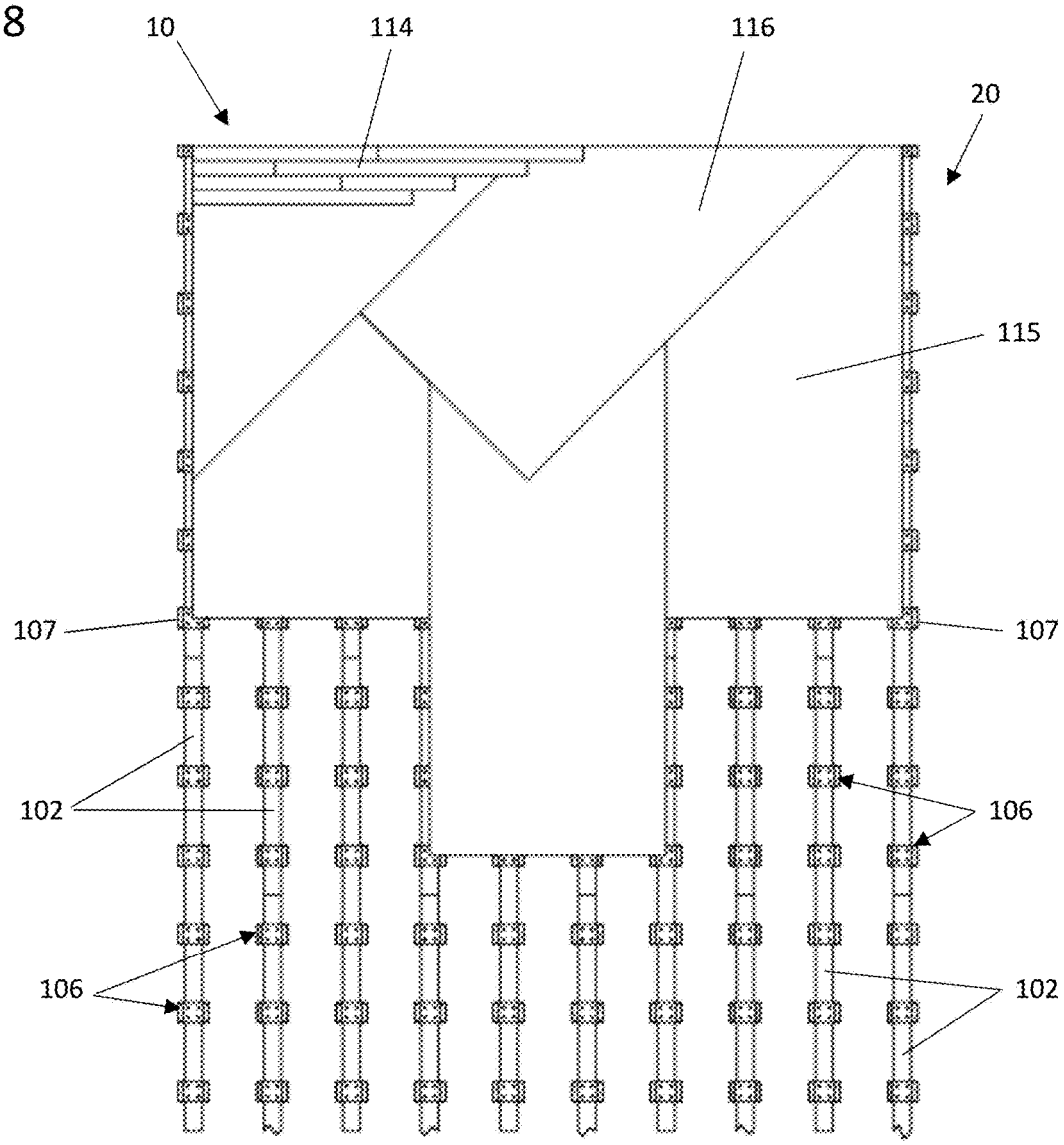
FIG. 8 is a top partial assembled view of components like those seen in FIG. 7, now showing a new athletic floor system.
Figure 9:
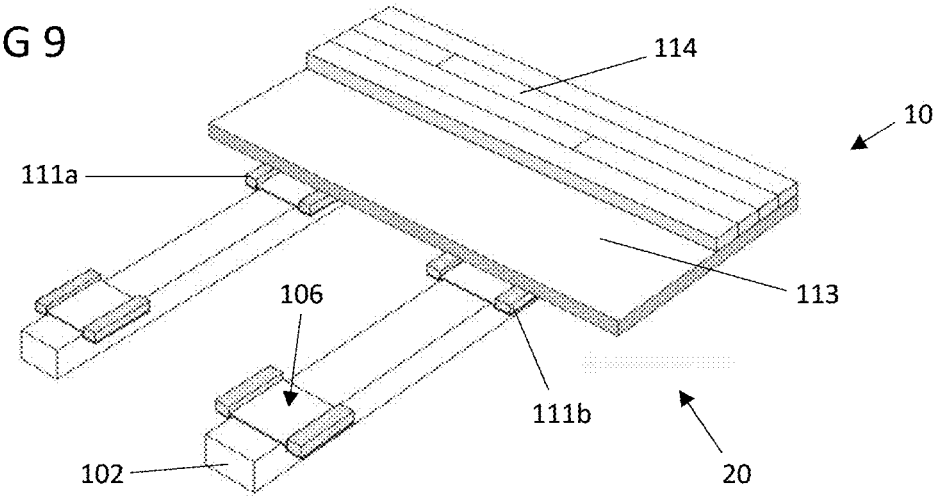
FIG. 9 is a perspective view of an alternate embodiment to that seen in FIG. 8.

Now, with specific reference to FIGS. 8-9 for example, there is a new athletic floor system 20. The system includes a plurality of channel sections 106 connected to a plurality of respective and separated supporting sleepers 102. System 20 further includes a plurality of left resilient pads 111*a* and a plurality of right resilient pads 111*b*, each resilient pad resting on a respective horizontal flange 109*a*, 109*b*. System 20 also includes the new floor 113, 114 resting on the plurality of left resilient pads 111*a* and the plurality of right resilient pads 111*b* and spaced from the plurality of top plates 107 the first distance in the first resilient compression condition. In the system 20, similar that seen in FIG. 10 for retrofit floor 10, the new floor can be spaced from the plurality of top plates 107 a second distance in a second resilient compression condition such that the second distance (FIG. 10) is less than the first distance (FIG. 7) as at least some of the plurality of left resilient pads 111*a* and at least some of the plurality of right resilient pads 111*b* are further compressed in response to compressive forces applied to the new floor.

Further in regards to system 20, resilient pads 111*a*, 111*b* can be resting and/or connected as previously described and are preferably spaced at 16 inches on center (though other spacing can be used as based on the original worn athletic floor) and connected via channel sections 106 to sleepers 102 remaining from the original floor installation. A lower sheathing layer 115 can be used and may be about ⅜ inch by 4 feet by 8 feet plywood panels aligned parallel to direction of sleepers 102 and set in a staggered brick pattern with ends offset by about 48 inches from ends of panels in adjacent rows. Long edges of panels can form the lower sheathing layer 115 and be aligned as centered over rows of sleepers 102 with each corner centered over top plates 107. An upper sheathing layer 116 can also be used and be aligned diagonally to the lower sheathing layer 115 and set in a staggered brick pattern with ends offset by about 48 inches from ends of panels in adjacent rows. Upper sheathing layer 116 can be attached to lower sheathing layer 115 by applying subfloor staples at about 12 inches on center and can be acceptably attached by other means such as wood screws, adhesive and/or other materials or structures as described previously, to connect these two components. Wood flooring surface 114 can be attached to the completed subfloor 113 by common flooring cleats or staples other means such as wood screws, adhesive and/or other materials or structures as described previously.

Figure 10:
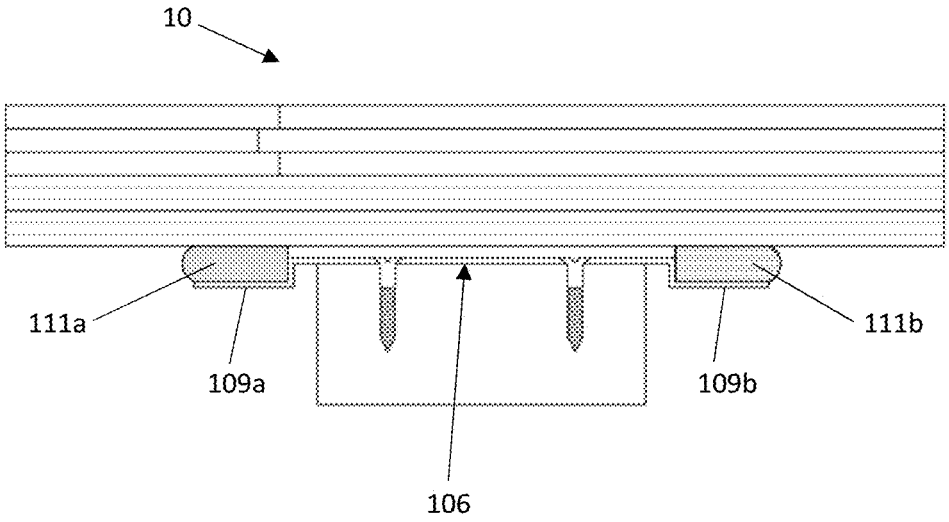
FIG. 10 is an end view like that seen in FIG. 7, with the new floor resting on the resilient pads and spaced from the top plate a second distance in a second resilient compression condition such that the second distance is less than the first distance as the left resilient pad and the right resilient pad are further compressed in response to compressive forces applied to the new floor.

In reference to FIG. 10, the new floor (113 and 114) is spaced from the top plate 107 the second distance in the second resilient compression condition such that the second distance is less than the first distance (FIG. 7) as the left resilient pad 111*a* and the right resilient pad 111*b* are further compressed in response to compressive forces applied to the new floor. That is, the resilient pads 111*a*, 111*b* are shown when partially deflected as reacting to athletic impacts on the floor surface 113, 114. The gauge thickness of channel section 106 is preferably such that, and the resilient pads 111*a*, 111*b* preferably have a density or deflective characteristic that compresses, preferably without significantly bending or changing the horizontal line of horizontal flanges 109*a*, 109*b*.

Figure 11:
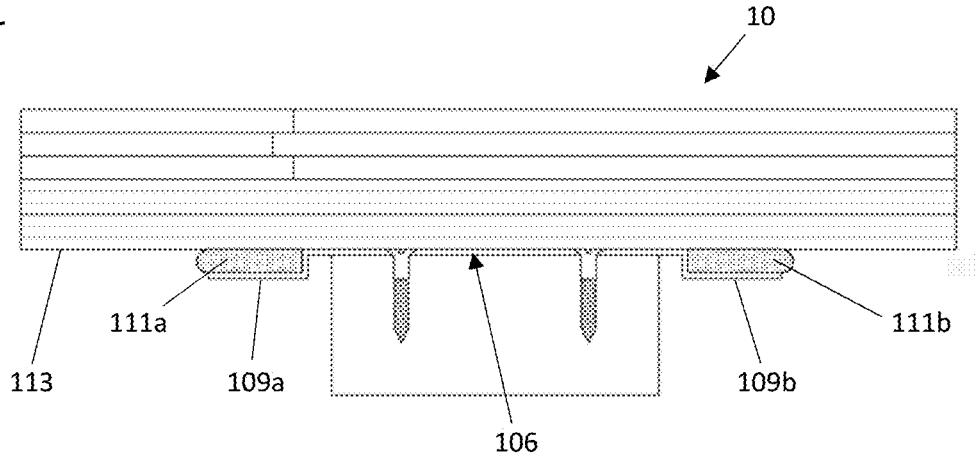
FIG. 11 is an end view like that seen in FIG. 10, with the new floor resting on the resilient pads and contacting the top plate in a third resilient compression condition that limits further compression of the left resilient pad and the right resilient pad in response to compressive forces applied to the new floor; and, FIG. 12 is a cross-sectional end view showing an alternate embodiment in which the new floor is movably-connected to the supporting sleeper.

Turning to FIG. 11, the new floor (namely, the underside of subfloor 113) is in contact with top plate 107 in a third resilient compression condition that limits further compression of the left resilient pad 111*a* and the right resilient pad 111*b* in response to compressive forces applied to the new floor. That is, the resilient pads 111*a*, 111*b* are shown more fully compressed as deflection is limited by the underside of subfloor 113 being in contact with the top surface of channel section 106. In the third resilient compression condition the resilient pads 111 are compressed to about half their initial thickness and, preferably, without exerting enough pressure to bend or change the horizontal line of the horizontal flanges 109*a*, 109*b*.

Figure 12:
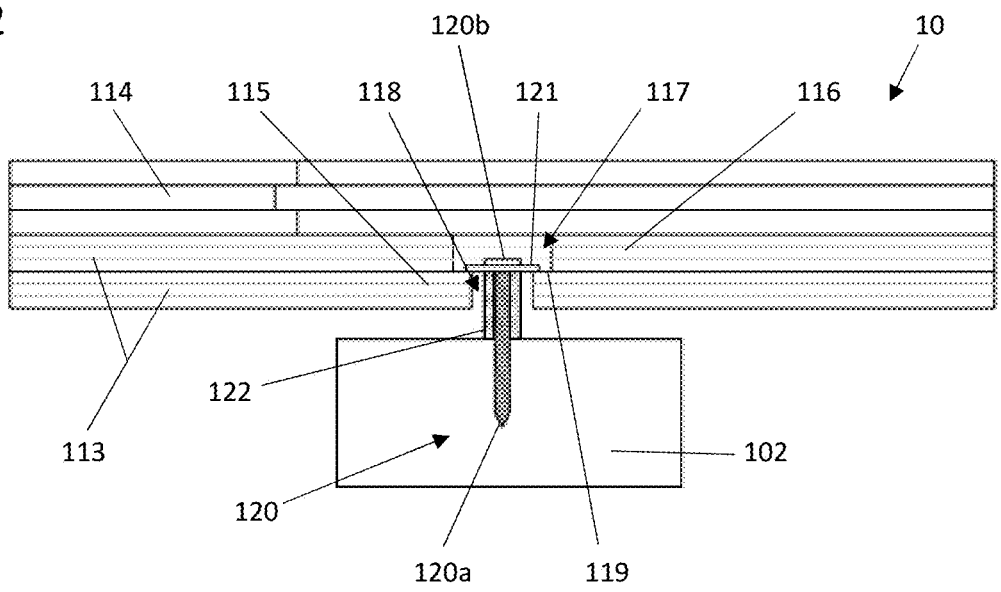

In reference to FIG. 12, an alternate embodiment of new athletic floor 10 includes a new manner to secure the subfloor 113 of the new floor to the sleepers 102 of the original floor. In one way, the new floor 113, 114 can be movably-connected to the supporting sleeper 102. For example, this can be by a fastener first end 120*a* connected to the supporting sleeper and the fastener second end 120*b* movably-connected to the subfloor in a void pocket 117. As such, fastener 120 is preferably a mechanical structure like a screw, bolt or the like. Further in regard to the movably-connected relationship, in one form, there is the inclusion of an about 1 inch diameter hole 117 bored through the upper sheathing layer 116 as centered over an about ⅝ inch diameter hole 118 in the lower sheathing layer 115 creating a countersunk shoulder 119 which in turn limits penetration of the fastener to the point at which a strategically wide washer 121 contacts the countersunk shoulder 119. A rubber sleeve 122 is included to limit overdriving the fastener 120 and insulate it from the adjacent wood material that can otherwise create squeaks. The void between the top of the fastener 120 and underside of the flooring surface 114 is such that deflection of the floor surface is not restricted as the floor surface 114 deflects toward the top of the fastener 120 when impacted by athletic and service loads. Desired spacing of fasteners can be provided at 16" on center in alternate sleeper rows and offset from aligning at channel section locations. For example, the location where each fastener 120 connects to the sleeper 102 can be the end of lead lines 102 seen in FIG. 8 and between adjacent plates 106.

My disclosure is also directed to a method to resiliently retrofit the worn athletic floor (FIG. 1) to have new wear life. The worn athletic floor includes supporting sleeper 102 connected to ground substrate 104. Steps of the method include connecting channel section 106 to supporting sleeper 102. Channel section 106 includes top plate 107 including left horizontal flange 109*a* extending outward from the top plate and right horizontal flange 109*b* extending outward from the top plate. A next step is resting left resilient pad 111*a* on left horizontal flange 109*a* and right resilient pad 111*b* on right horizontal flange 109*b*. Following this step is locating new floor on left resilient pad 111*a* and right resilient pad 111*b*. Then, there is the step compressing the resilient pads the first distance (FIG. 7) in response to the first resilient compression condition (e.g., floor 10 loaded with only the new floor, such as floor surface 114 and/or subfloor 113).

The method can also include the step removing a worn athletic floor portion, e.g., surface 100 and/or subfloor 102, from the supporting sleeper(s) 102 before connecting channel section 106 to supporting sleeper(s) 102. And, in reference to FIGS. 7-12, the method can include the steps performed in the following order one after the other: removing the worn athletic floor portion, connecting the channel section, resting the left resilient pad and the right resilient pad on its respective horizontal flange, locating the new floor, and compressing the left resilient pad and the right resilient pad.

During use of new athletic floor 10, and as exemplified in FIGS. 7, 10 and 11, the method can further include compressing the pads 111*a*, 111*b* the second distance in response to the second resilient compression condition such that the second distance is less than the first distance in response to compressive forces applied to the new floor, e.g., athletes on the new floor and playing some game of sports ball. Further, new athletic floor 10 can employ the step compressing the pads 111*a*, 111*b* in the third resilient compression condition that limits further compression of the resilient pads as the new floor (namely, component 113) comes into contact with top plate 107 in response to compressive forces applied to the new floor, e.g., an excess number of people on the new floor and/or equipment being moved over the new floor. Still further, as a reflection of the dynamic nature of new athletic floor 10 and its new wear life, the method can include returning the pads 111*a*, 111*b* to the first distance by removing the second resilient compression condition. And additionally, preferably, the method includes returning the pads 111*a*, 111*b* to the first distance or the second distance by, respectively, removing the second resilient compression condition or the third resilient compression condition. In practice, this application and removal of the resilient compression conditions happens successively many times and the athletic floor responds instantaneously to absorb and return opposite forces and provide an experience equivalent to the original floor or new floor standards, but with a more cost effective method and retrofit components.

In other aspects the method, in preferred embodiments, is directed to the configuration of certain components. For example, the method can include spacing the resilient pads 111*a*, 111*b* from the supporting sleeper 102 on opposite sides of the supporting sleeper (FIG. 4). Additionally, or alternatively, the method can include locating at least a bottom portion 111*c* of the resilient pads below an imaginary horizontal plane defined by a top surface 102*a* of the supporting sleeper (FIG. 3). Yet additionally, or alternatively, the method can include locating at least a top portion 111*d* of the resilient pads above an imaginary horizontal plane defined by the top surface 102*a* of the supporting sleeper (FIG. 3). For example, a combination of preferred thickness of the resilient pads 111*a*, 111*b* and preferred height of vertical side walls 108*a*, 108*b* results in the resilient pads being elevated about ¼ inch higher than the top plate 107 of the channel section 106.

In reference to FIG. 12, in other aspects of the method, the locating step may further include movably-connecting the new floor to the supporting sleeper 102. Still further, movably-connecting can be the step connecting fastener first end 120*a* to the supporting sleeper 102 and movably-securing the fastener second end 120*b* to subfloor 113 of the new floor. In this way, preferably, the fastener 120 and underside of the flooring surface 114 is such that deflection of the floor surface is not restricted as the floor surface 114 deflects toward the fastener second end 120*b* when impacted by athletic and service loads. This movably-connected relationship, in the various embodiments disclosed, limits horizontal displacement of the new floor relative to the supporting sleepers, without limiting the vertical displacement throughout the resilient compression conditions desired for new athletic floor 10 and system 20.

Each and every document cited in this present application, including any cross referenced or related patent or application, is incorporated in this present application in its entirety by this reference, unless expressly excluded or otherwise limited. The citation of any document is not an admission that it is prior art with respect to any embodiment disclosed in this present application or that it alone, or in any combination with any other reference or references, teaches, suggests, or discloses any such embodiment. Further, to the extent that any meaning or definition of a term in this present application conflicts with any meaning or definition of the same term in a document incorporated by reference, the meaning or definition assigned to that term in this present application governs.

The present invention includes the description, examples, embodiments, and drawings disclosed; but it is not limited to such description, examples, embodiments, or drawings. As briefly described above, the reader should assume that features of one disclosed embodiment can also be applied to all other disclosed embodiments, unless expressly indicated to the contrary. Unless expressly indicated to the contrary, the numerical parameters set forth in the present application are approximations that can vary depending on the desired properties sought to be obtained by a person of ordinary skill in the art without undue experimentation using the teachings disclosed in the present application. Modifications and other embodiments will be apparent to a person of ordinary skill in the art of athletic floors, and all such modifications and other embodiments are intended and deemed to be within the scope of the present invention.

What is claimed is:

1. An athletic floor resiliently retrofit to a worn athletic floor comprising a supporting sleeper connected to a ground substrate, the athletic floor comprising:

a channel section connected to the supporting sleeper, the channel section comprising a top plate located between and connected to each of a left vertical side wall spaced apart from a right vertical side wall, and wherein the top plate is connected to and positioned over the supporting sleeper;

the left vertical side wall including a left horizontal flange extending outward from the top plate and the right vertical side wall including a right horizontal flange extending outward from the top plate;

a left resilient pad resting on and positioned over the left horizontal flange wherein the left resilient pad is spaced from and located adjacent to a left side of the supporting sleeper and with a top horizontal surface of the left resilient pad located above a top horizontal surface of the supporting sleeper in a first resilient compression condition;

a right resilient pad resting on and positioned over the right horizontal flange wherein the right resilient pad is spaced from and located adjacent to a right side of the supporting sleeper and with a top horizontal surface of the right resilient pad located above the top horizontal surface of the supporting sleeper in the first resilient compression condition; and, a floor resting on the left resilient pad and the right resilient pad and spaced from the top plate a first distance in the first resilient compression condition.

2. The athletic floor of claim 1, wherein each vertical side wall is located outward from the supporting sleeper.

3. The athletic floor of claim 2, wherein a gap separates each vertical side wall from the supporting sleeper.

4. The athletic floor of claim 1, wherein each vertical side wall extends toward the ground substrate.

5. The athletic floor of claim 1, wherein at least one of the left horizontal flange and the right horizontal flange including a flange end stop to define a horizontal flange channel.

6. The athletic floor of claim 1, wherein at least one of the left horizontal flange and the right horizontal flange is indirectly connected to a respective left vertical side wall or right vertical side wall.

7. The athletic floor of claim 1, wherein the floor comprising a subfloor sitting underneath and connected to a floor surface.

8. The athletic floor of claim 7, wherein the floor is movably-connected to the supporting sleeper by a bolt first end connected to the supporting sleeper and a bolt second end movably-secured to the subfloor in a void pocket.

9. The athletic floor of claim 1, wherein the floor is movably-connected to the supporting sleeper.

10. The athletic floor of claim 1, wherein the floor is spaced from the top plate a second distance in a second resilient compression condition such that the second distance is less than the first distance as the left resilient pad and the right resilient pad are further compressed in response to compressive forces applied to the floor.

11. The athletic floor of claim 10, wherein the floor is in contact with the top plate in a third resilient compression condition that limits further compression of the left resilient pad and the right resilient pad in response to compressive forces applied to the floor.

12. The athletic floor of claim 1, comprising an athletic floor system, including:

a plurality of channel sections connected to a plurality of respective and separated supporting sleepers;

a plurality of left resilient pads and a plurality of right resilient pads, each resilient pad resting on a respective horizontal flange; and, the floor resting on the plurality of left resilient pads and the plurality of right resilient pads and spaced from a plurality of top plates a first distance in a first resilient compression condition.

13. The athletic floor of claim 12, wherein the floor is spaced from the plurality of top plates a second distance in a second resilient compression condition such that the second distance is less than the first distance as at least some of the plurality of left resilient pads and at least some of the plurality of right resilient pads are further compressed in response to compressive forces applied to the floor.

14. A method to resiliently retrofit a worn athletic floor to have additional wear life, the worn athletic floor comprising a supporting sleeper connected to a ground substrate, comprising the steps:

connecting a channel section to the supporting sleeper, the channel section comprising a top plate including a left horizontal flange extending outward from the top plate and a right horizontal flange extending outward from the top plate, and wherein the top plate is connected to and positioned over the supporting sleeper;

resting a left resilient pad on and positioned over the left horizontal flange wherein the left resilient pad is spaced from and located adjacent to a left side of the supporting sleeper and locating a top horizontal surface of the left resilient pad above a top horizontal surface of the supporting sleeper in a first resilient compression condition;

resting a right resilient pad on and positioned over the right horizontal flange wherein the right resilient pad is spaced from and located adjacent to a right side of the supporting sleeper and locating a top horizontal surface of the right resilient pad above the top horizontal surface of the supporting sleeper in the first resilient compression condition;

locating a floor on the left resilient pad and the right resilient pad; and, compressing the left resilient pad and the right resilient pad a first distance in response to the first resilient compression condition.

15. The method of claim 14, further comprising the step removing the worn athletic floor portion before doing the step connecting the channel section to the supporting sleeper.

16. The method of claim 14, wherein the locating step is further comprising movably-connecting the floor to the supporting sleeper.

17. The method of claim 16, wherein movably-connecting comprises connecting a bolt to the supporting sleeper and movably-securing the bolt to a subfloor of the floor.

18. The method of claim 14, further comprising compressing the left and right resilient pads a second distance in response to a second resilient compression condition such that the second distance is less than the first distance in response to compressive forces applied to the floor.

19. The method of claim 18, further comprising compressing the left and right resilient pads in a third resilient compression condition that limits further compression of the left and right resilient pads as the floor comes into contact with the top plate in response to compressive forces applied to the floor.

20. The method of claim 18, further comprising returning the left and right resilient pads to the first distance by removing the second resilient compression condition.

21. The method of claim 19, further comprising returning the left and right resilient pads to the first distance or the second distance by, respectively, removing the second resilient compression condition or the third resilient compression condition.

22. The method of claim 14, further comprising completely spacing the left and right resilient pads from the supporting sleeper on opposite sides of the supporting sleeper.

23. The method of claim 14, further comprising locating at least a bottom portion of the left and right resilient pads below an imaginary horizontal plane defined by a top surface of the supporting sleeper.

24. The method of claim 23, further comprising locating at least a top portion of the left and right resilient pads above an imaginary horizontal plane defined by the top surface of the supporting sleeper.

25. The method of claim 14, wherein the steps are performed in the following order one after the other: removing the worn athletic floor portion, connecting the channel section, resting the left resilient pad and the right resilient pad on respective horizontal flanges, locating the floor, and compressing the left resilient pad and the right resilient pad.

26. An athletic floor resiliently retrofit to a worn athletic floor comprising a supporting sleeper connected to a ground substrate, the athletic floor comprising:

a channel section connected to the supporting sleeper, the channel section comprising a top plate located between and connected to each of a left vertical side wall spaced apart from a right vertical side wall;

the left vertical side wall including a left horizontal flange extending outward from the top plate and the right vertical side wall including a right horizontal flange extending outward from the top plate;

a floor located over and resting on a left resilient pad and a right resilient pad wherein the left resilient pad is located between the left horizontal flange and the floor and the right resilient pad is located between the right horizontal flange and the floor, and the floor is spaced from the top plate a first distance in a first resilient compression condition; and, when in the first resilient compression condition at least a bottom portion of the left and right resilient pads being located below an imaginary horizontal plane defined by a top surface of the supporting sleeper and at least a top portion of the left and right resilient pads being located above an imaginary horizontal plane defined by the top surface of the supporting sleeper.

27. The athletic floor of claim 26, wherein the floor is spaced from the top plate a second distance in a second resilient compression condition such that the second distance is less than the first distance as the left resilient pad and the right resilient pad are further compressed in response to compressive forces applied to the floor.

* * * * *